United States Patent [19]

Chuang

[11] 4,133,713

[45] Jan. 9, 1979

[54] MICROTURBULENCE GENERATOR FOR PAPERMACHINE HEADBOX

[75] Inventor: Strong C. Chuang, Cincinnati, Ohio

[73] Assignee: The Procter & Gamble Company, Cincinnati, Ohio

[21] Appl. No.: 841,494

[22] Filed: Oct. 11, 1977

[51] Int. Cl.[2] ..... D21F 1/02

[52] U.S. Cl. ..... 162/216; 162/341; 162/343; 162/347

[58] Field of Search ..... 162/216, 341, 343, 347

[56] References Cited

U.S. PATENT DOCUMENTS

| | | | |
|---|---|---|---|
| Re. 28,269 | 12/1974 | Hill et al. | 162/343 |
| 2,832,268 | 4/1958 | Boone et al. | 162/216 |
| 3,843,470 | 10/1974 | Betley et al. | 162/343 |
| 3,853,694 | 12/1974 | Parker et al. | 162/216 |
| 3,923,593 | 12/1975 | Verseput | 162/343 X |
| 3,939,037 | 2/1976 | Hill | 162/343 X |

FOREIGN PATENT DOCUMENTS

| | | | |
|---|---|---|---|
| 452642 | 5/1975 | U.S.S.R. | 162/343 |
| 475433 | 9/1975 | U.S.S.R. | 162/343 |

OTHER PUBLICATIONS

Parker et al., "Simultaneous Convergence . . . ", *TAPPI,* vol. 51, No. 10, Oct. 1968, pp. 425–432.

*Primary Examiner*—Richard V. Fisher
*Attorney, Agent, or Firm*—E. K. Linman; J. V. Gorman; R. C. Witte

[57] ABSTRACT

A microturbulence generator for a papermachine headbox flow channel complying with newly developed parametric criteria for optimizing its effectiveness and methods of adjusting the position of said microturbulence generator while said papermachine is in-use to accommodate changes in operating conditions and/or machine speed are disclosed. A microturbulence generator complying with the optimization criteria of the present invention serves to generate a sufficient degree of microturbulence near the headbox throat to effectively disperse pulp floc in a macroturbulent stream of papermaking fibers to improve formation characteristics, randomize fiber orientation and reduce tensile ratio in the resulting paper web. The disclosed criteria are generally applicable to headbox flow channels having an angle of convergence between about 4° and about 20° and are particularly effective at papermachine speeds in excess of about 800 feet per minute.

14 Claims, 12 Drawing Figures

Fig. 1
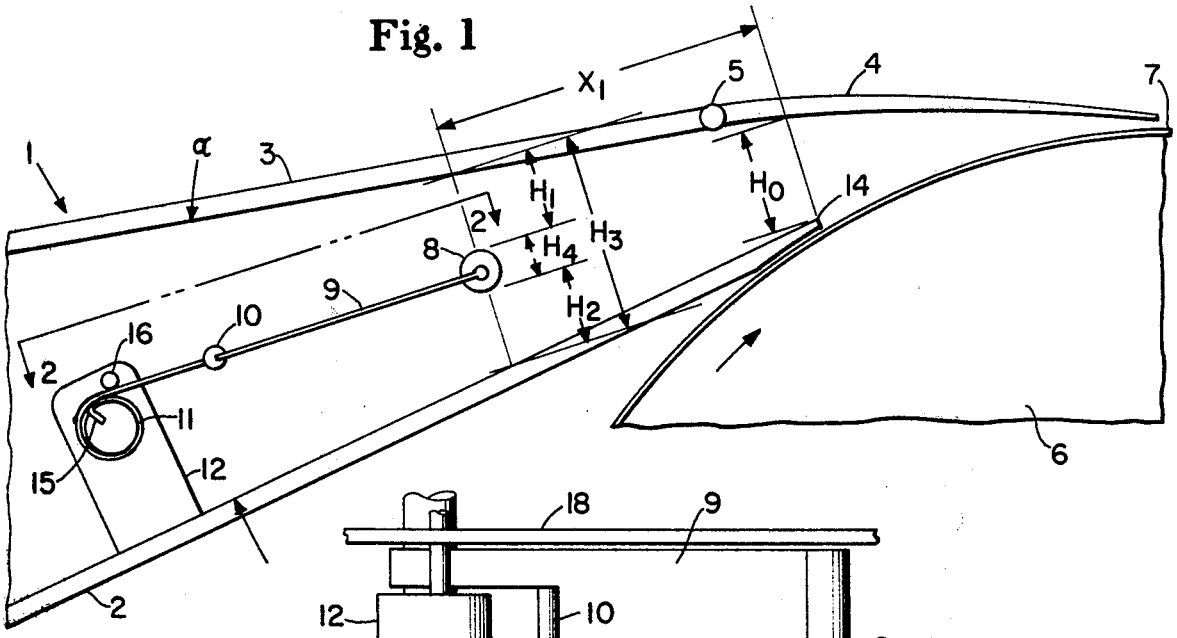
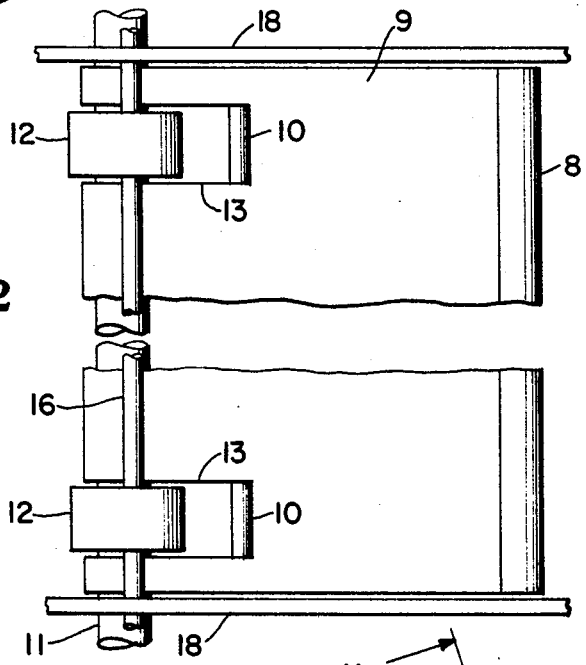
Fig. 2
Fig. 3
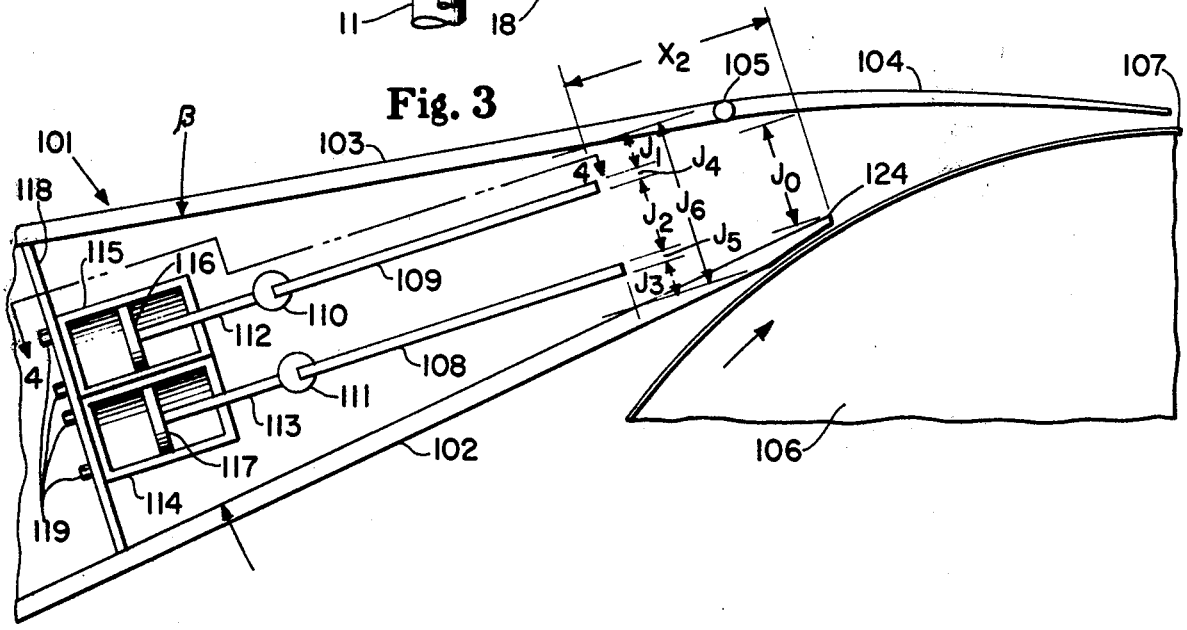

MACHINE DIRECTION

MACHINE DIRECTION

MACHINE DIRECTION

MICROTURBULENCE GENERATOR FOR PAPERMACHINE HEADBOX

FIELD OF THE INVENTION

The present invention relates generally to a headbox flow channel for a papermaking machine, and more particularly to a headbox flow channel employing at least one microturbulence generator complying with newly developed parametric criteria which optimize the level of microturbulence generation for a given papermachine condition. In a particularly preferred embodiment, the present invention permits the operator to move the microturbulence generator closer toward or further from the throat area of the headbox flow channel while the papermachine is operational.

BACKGROUND OF THE INVENTION

A significant difficulty in achieving uniform formation of a paper web on a traveling forming surface is the natural tendency of the fibers to flocculate, i.e., to aggregate or coalesce into small fibrous lumps or loose clusters in the slurry. An objective in Fourdrinier machine designs, and particularly the headbox, has been to disperse the fiber networks during the period of flow through the headbox in such a manner that flocculation has the least tendency to occur on the forming wire surface. Prior art solutions have attempted to accomplish this within the headbox of generating turbulence.

A basic limitation in headbox design has been that the means for generating turbulence in fiber suspensions in order to disperse them have been comparatively large scale or macroturbulence generating devices only. With such devices, it is possible to develop small scale or microturbulence only by increasing the intensity of turbulence generated. As will be appreciated by those skilled in the art, the generation of turbulence presents a continuous spectrum with respect to wavelength. However, for purposes of this specification, microturbulence shall generally be considered as that having a wavelength of about 6 millimeters or less, while macroturbulence shall generally be considered as that having a wavelength of about 40 millimeters or greater. Since the turbulence energy is transferred naturally from large to small scales, the higher the intensity the greater will be the rate of energy transfer and hence, the smaller the scales of turbulence sustained. However, a detrimental effect is also produced by an excessive degree of high intensity large scale turbulence, namely, the large waves and free surface disturbances developed in the slurry on the Fourdrinier table. Thus, a general rule of prior art headbox performance has been that the degree of dispersion and level of turbulence in the headbox discharge were closely correlated, i.e., the higher the turbulence level, the better the dispersion.

Accordingly, one could select either a design that produces a highly turbulent, well dispersed discharge, or one that produces a low turbulent, poorly dispersed discharge. Since either a very high level of turbulence or a very low level (and consequent poor dispersion) produce defects in sheet formation on the Fourdrinier machine, the art of headbox design has typically consisted of making a suitable compromise between these extremes. That is, a primary objective of prior art headbox design has been to generate a level of turbulence which was high enough for dispersion, but low enough to avoid free surface defects during the formation period. This compromise is, of course, different for different types of papermaking furnish, fiber consistencies, Fourdrinier table designs, machine speeds, etc. Furthermore, most such prior art compromises sacrifice either the best possible dispersion or the best possible flow pattern on the Fourdrinier wire.

The defects in sheet formation as a result of these extremes in headbox design, i.e., very high or very low turbulence, are even more marked when one employs a Fourdrinier machine wherein all table rolls and foils are replaced by suction boxes. Thus when the turbulence is very low, as for example in the discharge from a conventional rectifier roll type headbox, the formation of the sheet formed by the rapid drainage over suction boxes in the absence of the table roll activity directly reflects the poor dispersion in the discharge jet. On the other hand, when the turbulence is very high, a wave pattern is generated in the free surface of the flow on the wire as a consequence of the turbulence. With rapid drainage of the suspension in this case, the formation of the sheet reflects the mass distribution pattern of these waves. In addition to the free surface wave patterns, excessive turbulence may also entrain air and disrupt the thickened fiber mat which had been deposited earlier, causing formation defects.

Thus, not only are the prior art extremes of headbox characteristics unsuitable, but it is also difficult to find a suitable compromise for a suction box Fourdrinier application.

U.S. Pat. No. 3,939,037 issued to Hill on Feb. 17, 1976 discloses one method of providing a fine scale turbulence without large scale eddies in the discharge jet by passing the fiber suspension through a system of parallel channels of uniform small size, but large in percentage open area. Both of these conditions, uniform small channel size and large exit percentage open area, are critical according to the teachings of Hill. Thus, the largest scales of turbulence developed in the channel flow have the same order of size as the depth of the individual channels. By maintaining the individual channel depth small, the resulting scale of turbulence will be small. It is likewise critical, according to Hill, to have a large exit percentage open area to prevent the development of large scales of turbulence in the zone of discharge. That is, large solid areas between the channels' exits would, according to Hill, result in the generation of large scale turbulence in the wake of those areas. In the Hill concept, the flow channels must change from a large entrance to a small exit size over a substantial distance to allow time for the large scale coarse flow disturbances generated in the wake of the entrance structure to be degraded to the small scale turbulence desired in the discharge jet.

The approach followed by Hill is thus one of attenuating large scale turbulence generated upstream of the headbox throat to sustain the desired level of small scale turbulence at the discharge jet. Because the geometry of the Hill system of parallel channels of uniform small size is fixed, any change in papermachine operating conditions or speed from the original design condition causes the level of small scale turbulence sustained in the discharge jet to move away from the optimum design level. Thus, the solution suggested by Hill offers the papermaker little flexibility in terms of ability to vary either the operating parameters or the speed of the papermachine if he desires to sustain the optimum level of small scale turbulence in the discharge jet.

OBJECTS OF THE INVENTION

Accordingly, it is an object of the present invention to generate an optimum microturbulence level in an area of the headbox flow channel which is sufficiently close to the channel's throat that the desired level of turbulence is maintained in the slurry exiting the throat.

It is another object of the present invention to eliminate the need for generating excessive large scale or macroturbulence in the headbox merely to sustain the desired level of microturbulence at the headbox flow channel throat.

It is yet another object of the present invention to provide a microturbulence generator which is adjustable in-use and which permits the operator to alter the position of the microturbulence generator in the throat while the papermachine is operational, thereby optimizing the desired level of microturbulence generation for the particular operating conditions and papermachine speed selected by the papermaker.

SUMMARY OF THE INVENTION

In order to generate a level of microturbulence sufficient to disperse pulp floc, improve formation characteristics, randomize fiber orientation in the discharge jet and reduce tensile ratio of the finished sheet, two newly developed design parameters must be considered. The first of theses, $\gamma_b$, is equal to the cross-sectional flow area measured just prior to expansion at the microturbulence generator divided by the cross-sectional flow area which would exist absent the restriction in the flow channel, while the second, $\gamma_s$, is equal to the cross-sectional flow area measured at the microturbulence generator divided by the minimum cross-sectional flow area existing downstream, which normally occurs at the flow channel's throat. Consequently, the latter measurement is normally made coterminous with the end of the headbox floor. The preferred $\gamma_b$ and $\gamma_s$ criteria are generally applicable in papermaking machine headbox flow channels for delivering an aqueous papermaking stock to a foraminous forming surface at a throat velocity of at least about 800 feet per minute, wherein the flow channel in question has an angle of convergence between about 4° and about 20° and the microturbulence generator is located in said flow channel between about 1 inch and about 10 inches from the point of minimum cross-sectional flow area. It has been found that the desired objectives can be met in flow channels of the aforementioned variety when the particular microturbulence generator exhibits a $\gamma_b$ value between about 0.3 and about 0.7 in conjunction with a $\gamma_s$ value between about 1.0 and about 1.6. In a particularly preferred embodiment of the present invention, the position of the microturbulence generator is adjustable in the machine direction while the papermaking machine is in operation to facilitate fine tuning of the system to an optimum level of microturbulence in the discharge jet.

BRIEF DESCRIPTION OF THE DRAWINGS

While the specification concludes with claims particularly pointing out and distinctly claiming the subject matter which is regarded as forming the present invention, it is believed that the present invention will be better understood from the following description taken in connection with the accompanying drawings in which:

FIG. 1 is a simplified cross-sectional schematic illustration of a papermachine headbox in which a microturbulence generator of the present invention has been provided;

FIG. 2 is a plan view of the microturbulence generator illustrated in FIG. 1 taken at a point corresponding to that of view line 2—2 in FIG. 1;

FIG. 3 is a simplified schematic cross-sectional illustration of another embodiment of the present invention wherein a pair of plates are utilized as microturbulence generators;

DESCRIPTION OF THE PREFERRED EMBODIMENTS

Figure 4:
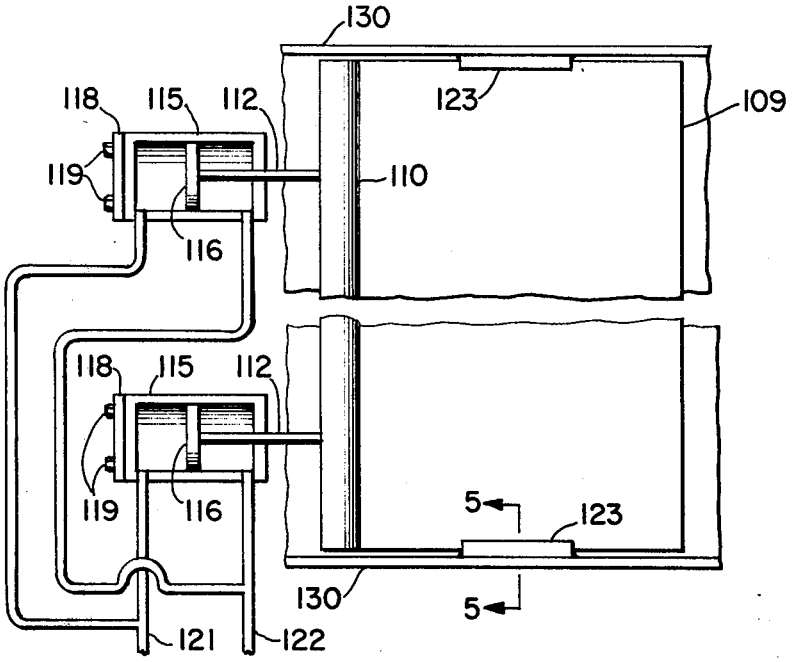
FIG. 4 is a plan view of the turbulence generator illustrated in FIG. 3 taken along view line 4—4 in FIG. 3.

The present invention provides method and apparatus for forming a moist paper web exhibiting improved formation characteristics, improved fiber dispersion and randomized fiber orientation without undesirable surface disruptions at papermachine speeds of about 800 feet per minute or greater. In a preferred embodiment, said method comprises:

(a) introducing macroturbulent flow to a dilute aqueous slurry of papermaking fibers upon introduction to a convergent papermachine headbox flow channel;

(b) directing said macroturbulent flow of papermaking fibers toward the throat of said flow channel at an angle of convergence between about 4° and about 20°;

(c) introducing microturbulence to said macroturbulent flow of papermaking fibers within said headbox flow channel at a point sufficiently near the throat of said headbox flow channel that the microturbulence remaining in the discharge jet minimizes flocculation and promotes dispersion and random orientation of said papermaking fibers; and (d) discharging said flow of papermaking fibers through said headbox throat in the form of a jet to form a moist paper web on a traveling foraminous support member.

In a particularly preferred embodiment of the present invention, said microturbulence is generated by first constricting and then momentarily expanding the flow of said papermaking fibers to a cross-sectional area between about 1.4 and about 3.3 times it constricted cross-sectional area in said converging channel. Said constriction and momentary expansion are preferably carried out at a point between about 1 and about 10 inches upstream of the throat of said headbox flow channel, and the flow is thereafter reconstricted after said momentary expansion has been carried out to a cross-sectional area between about 0.625 and about 1.0 times its original constricted cross-sectional area at the throat of said headbox flow channel.

FIG. 1 is a simplified cross-sectional schematic illustration of a preferred embodiment of the present invention. A conventional fixed roof forming headbox 1 delivers a flow of dilute fibrous papermaking stock onto the surface of a foraminous Fourdrinier wire 7 operating about a suction breast roll 6. The headbox has a fixed floor portion 2 and a roof or ceiling comprising a portion 3, which shall for purposes of the present specification be considered fixed, and a pivotal portion 4 which can be adjustably articulated about knuckle 5. The throat of the headbox shall, for purposes of the present specification, be defined as coincident with the point of termination 14 of the fixed floor portion 2. The height of the throat opening, $H_O$, which normally corresponds to the point of minimum cross-sectional flow area downstream of the microturbulence generator is thus established by the positioning of the pivotal portion 4 of the headbox ceiling. The angle of the convergence $\alpha$ of a single channel headbox shall be defined as the angle formed between the ceiling portion 3 of the headbox and the fixed floor portion 2.

A cylindrical microturbulence generator 8 of the present invention is supported in the flow channel of the headbox 1 at the trailing edge of a flexible sheet member 9 to which it is affixed by means well known in the art. The flexible sheet member 9 preferably passes through a nip formed between roll 16 and shaft 11 about which the sheet member is wrapped and secured at point 15 by means well known in the art. The shaft 11 may be secured in position in the headbox 1 by a pair of support members 12 affixed to the floor portion 2 of the headbox.

As can be seen in FIG. 2, which is taken along view line 2—2 of FIG. 1, the microturbulence generator 8, the flexible sheet member 9 supporting the microturbulence generator, and the shafts 11 and 16 extend across the full width of the headbox. Shafts 11 and 16 which project through the sides 18 of the headbox are rotatably mounted in the sides of the headbox so as to permit rotation thereof from a position external to the headbox. The flexible sheet member 9 is equipped with openings 13 to permit machine direction extension or retraction of the mictroturbulence generator 8 by rotation of shaft 11 without interference from shaft supports 12. The circular members 10 affixed to the downstream end of the openings 13 are utilized to prevent pulp floc from accumulating at these points and thereby causing nonuniform disturbances in the flow channel.

As is apparent from FIGS. 1 and 2, the machine direction position of the microturbulence generator 8 may be adjusted while the papermachine is in operation by rotating the external portion of shaft 11 to which the flexible support member 9 is affixed at point 15. Clockwise rotation will place the microturbulence generator 8 closer to the throat of the headbox, while counterclockwise rotation of the shaft 11 will move the microturbulence generator further upstream from the throat of the headbox.

While various forms of turbulence generators are well known in the prior art, it has been unexpectedly determined that only microturbulence generators complying with the parametric design criteria set forth herein will enable the papermaker to optimize the dispersion of pulp floc, improve overall sheet formation characteristics and randomize fiber orientation to reduce tensile ratio in the finished paper sheets in a predictable manner. Furthermore, by introducing the desired degree of small scale or microturbulence near the headbox throat, it is no longer necessary to introduce excessive large scale or macroturbulence far upstream of the headbox throat merely to ensure that sufficient microturbulence remains at the headbox throat to avoid flocculation in the discharge jet. Thus, the present invention enables the papermaker to select the optimum level of macroturbulence independently of the level of microturbulence desired to obtain optimum sheet formation characteristics. In essence, it eliminates or at least minimizes the need to compromise between poor fiber dispersion typically produced by prior art low turbulent discharge jets and objectionable sheet disturbances typically produced by prior art high turbulent discharge jets.

The parametric design criteria set forth herein function effectively to generate an optimum level of microturbulence in flow channels having an angle of convergence between about 4° and about 20°, most preferably between about 6° and about 15°, at papermachine speeds ranging from about 800 feet per minute through the maximum papermachine speeds currently achievable by the industry, i.e., on the order of about 5,000 to 6,000 feet per minute. They may be employed with equal facility on fixed roof style headboxes of the type generally described herein or with twin-wire style headboxes which discharge a jet of aqueous paperstock intermediate a pair of convergent foraminous forming surfaces.

It is to be emphasized, however, that it is imperative that a sufficient degree of large scale or macroturbulence be introduced to the flowing stream at the inlet section of the headbox flow channel by means well known in the art, i.e., various forms of flow obstructions, so that the microturbulence generated by the present invention may interact therewith to produce the desired improvements in sheet formation and tensile ratio. In this regard, any suitable large scale or macroturbulence generating device such as a multiple orifice plate of the type generally disclosed in U.S. Pat. No. 3,598,696 issued to Beck on Aug. 19, 1971, U.S. Pat. No. 3,923,593 issued to Verseput on Dec. 2, 1975 or U.S. Pat. No. 3,939,037 issued to Hill on Feb. 17, 1976 may be employed.

For maximum effectiveness, the small scale or microturbulence is preferably generated just upstream of the point of minimum cross-sectional flow area (which normally occurs at the headbox throat), i.e., preferably between about 1 and about 10 inches upstream of the headbox throat, and most preferably between about 3 and about 7 inches upstream of the headbox throat. In general, it has been determined that the slower the papermachine speed, the closer should be the microturbulence generator to the throat.

In order to impart an optimum level of microturbulence to a flow of stock which has already been subjected to an optimum level of macroturbulence generation upon entry into the headbox, two design parameters must be simultaneously met. The first of these, $\gamma_b$ is equal to the cross-sectional flow area just prior to expansion at the microturbulence generator, as measured at the microturbulence generator, divided by the cross-sectional flow area which would exist absent the microturbulence generator. The second, $\gamma_s$, is equal to the cross-sectional flow area just prior to expansion at the microturbulence generator divided by the minimum cross-sectional flow area occurring downstream of the microturbulence generator, which is normally at the headbox throat. In order to satisfy the design criteria of the present invention, a $\gamma_b$ value between about 0.3 and about 0.7 and a $\gamma_s$ value between about 1.0 and about 1.60 are employed in conjunction with one another. A $\gamma_b$ value of about 0.3 momentarily expands the flow of papermaking fibers to a cross-sectional area about 3.3 times its constricted cross-sectional area, while a $\gamma_b$ value of about 0.7 momentarily expands the flow of papermaking fibers to a cross-sectional area about 1.4 times its constricted cross-sectional area. A $\gamma_s$ value of about 1.0 reconstricts the flow of papermaking fibers after said momentary expansion has been carried out to a cross-sectional area about 1.0 times its constricted cross-sectional area, while a $\gamma_s$ value of about 1.6 reconstricts the flow of papermaking fibers to a cross-sectional area about 0.625 times its constricted cross-sectional area. Thus, for the headbox configuration illustrated in FIG. 1, $$\gamma_b = \frac{H_1 + H_2}{H_3},$$

where $H_3 = H_1 + H_2 + H_4$, and $$\gamma_s = \frac{H_1 + H_2}{H_0}.$$

As is apparent from FIG. 1, $H_1$ and $H_2$ represent the heights of the uppermost and lowermost unobstructed flow areas, measured at the point of maximum height $H_4$ of the microturbulence generator 8 in a direction substantially perpendicular to the direction of flow. The width of the headbox, as measured in the cross-machine direction, is identical for both the uppermost and lowermost flow areas, and the microturbulence generator is of uniform cross-section across the width of the papermachine in the illustrated embodiment. Accordingly, the heights may be employed directly in calculation of the $\gamma_b$ and $\gamma_s$ values, since they are directly proportional to the cross-sectional flow areas. Where the microturbulence generator is of nonuniform cross-section in the cross-machine direction, however, the respective cross-sectional flow areas must be employed in the calculations.

When the minimum cross-sectional flow area downstream of the microturbulence generator occurs at the throat, as in the illustrated embodiment, the height of the headbox throat $H_0$ is measured at a point 14 coincident with the termination of the headbox floor portion 2 in a direction generally perpendicular to the direction of flow, i.e., generally perpendicular to a line bisecting the angle of convergence $\alpha$ of the headbox 1. The machine direction distance between the point of minimum flow area downstream of the microturbulence generator, in this case the headbox throat, and the point of maximum height of the microturbulence generator 8, as measured along a line bisecting the angle of convengence $\alpha$, is depicted by $X_1$ which is preferably between about 1 inch and about 10 inches, most preferably between about 3 inches and about 7 inches. Thus in the preferred embodiment of the invention illustrated in FIG. 1, the openings 13 in support member 9 have a length sufficient to permit extension and retraction of the microturbulence generator 8 to a position between about 1 inch and about 10 inches from the headbox throat.

As should be apparent from the foregoing description, rotating shaft 11 in a clockwise direction wil advance the position of the microturbulence generator 8 toward the headbox throat, thereby decreasing the values of both $\gamma_b$ and $\gamma_s$, while rotating the shaft 11 in a counterclockwise direction will move the microturbulence generator 8 further upstream from the headbox throat, thereby increasing the values of $\gamma_b$ and $\gamma_s$. Smaller values of $\gamma_b$ and $\gamma_s$ yield a higher turbulence intensity level. For lower papermachine speeds, i.e., speeds approaching about 800 feet per minute, lower values of $\gamma_b$ and $\gamma_s$ are generally preferred, i.e., the microturbulence generator is positioned relatively close to the headbox throat. Conversely, as the papermachine speed is increased, higher values of $\gamma_b$ and $\gamma_s$ are preferred, i.e., the microturbulence generator is further removed from the headbox throat.

In the embodiment of the invention depicted in FIG. 1, a homogeneous stock flow on both sides of the flexible support member 9 is contemplated. Thus, the uniform pressure applied to both sides of the flexible support member 9 will cause the microturbulence generator 8 to seek a position approximately midway between the headbox ceiling 3 and the headbox floor 2. Rotatable shaft 16, although not critical to the practice of the present invention, is nonetheless preferred to maintain the flexible support member 9 wrapped securely about shaft 11 and to prevent flutter of the support member in operation.

It should be noted that while a flexible sheet member 9 is employed to support the microturbulence generator 8 in the illustrated embodiment, a similar result may be achieved by the use of wires or other suitable support means capable of extension of retraction in the machine direction.

FIG. 3 illustrates an alternative embodiment of the present invention installed in a headbox 101 operating to deliver stock to a Fourdrinier wire 107 wrapped about a suction breast roll 106 in a manner similar to that illustrated in FIG. 1. The headbox 101 comprises roof portion 103, which for purposes of the present specification shall be considered fixed, forming an angle of convergence $\beta$ with the floor portion 102 and including a pivotally movable roof portion 104 which can be adjusted about knuckle 105. The microturbulence generators in this case comprise flate plates 108 and 109 having a thickness of $J_5$ and $J_4$, respectively, said plates extending uniformly across the entire width of the papermachine headbox. The plates are secured at their upstream ends by means of clevis members 110 and 111 which are in turn secured to cylinder shafts 112 and 113, respectively. Cylinders 114 and 115 are secured at their upstream ends to a stationary support member 118 interconnecting the headbox floor 102 and the headbox ceiling 103 by suitable means well known in the art, i.e., a plurality of cap screws 119. Cylinder shafts 112 and 113 are connected to pistons 116 and 117, respectively.

The machine direction position of the end of the plates 108 and 109 may be controlled in-use by regulating the flow of hydraulic fluid to the upstream and downstream ends of the cylinders. As is shown in FIG. 4, which is a plan view taken along view line 4—4 of FIG. 3, the upstream ends of the cylinders are tied together by means of a common supply line 121, while the downstream ends of the cylinders are tied together by means of a common supply line 122. Thus, the position of the microturbulence generators 108 and 109 is controlled very simply by means of a hydraulic control valve located externally of the headbox which is utilized to regulate the flow of hydraulic fluid to opposite sides of the pistons 116 and 117 in the cylinders.

Figure 5:
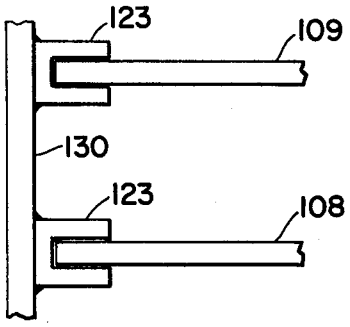
FIG. 5 is a cross-sectional view of the pond side bracket utilized to support the plates illustrated in FIG. 4, taken along section line 5—5 in FIG. 4.

As can be seen in both FIG. 4 and in the cross-sectional view of FIG. 5, the lateral edges of the turbulence generators 108 and 109 are supported at their pond sides by means of channels 123 secured to the headbox sidewalls 130.

In the embodiment illustrated in FIGS. 3-5, $\gamma_b$ is given by the relation $$\gamma_b = \frac{J_1 + J_2 + J_3}{J_6},$$

where $J_6 = J_1 + J_4 + J_2 + J_5 + J_3$, and $\gamma_s$ is given by $$\gamma_s = \frac{J_1 + J_2 + J_3}{J_0},$$

where $J_0$ equals the height of the headbox throat, as measured at a point 124 coincident with the point of termination of the headbox floor portion 102 in a direction substantially perpendicular to the direction of stock flow. $J_1$, $J_2$ and $J_3$ represent the heights of the cross-sectional flow areas of the headbox flow channel just prior to the point of expansion, i.e., the downstream edge of plates 108 and 109.

As should be apparent from the foregoing, the position of the microturbulence generators, i.e., the downstream edge of plates 108 and 109, is adjustable in the machine direction while the machine is in full scale operation to permit optimization of the distance $X_2$ between the microturbulence generators and the minimum cross-sectional flow area downstream thereof, i.e., in this case the headbox throat. This of course results in optimization of $\gamma_b$ and $\gamma_s$ for the particular operating conditions and speed chosen by the papermaker.

Figure 6:
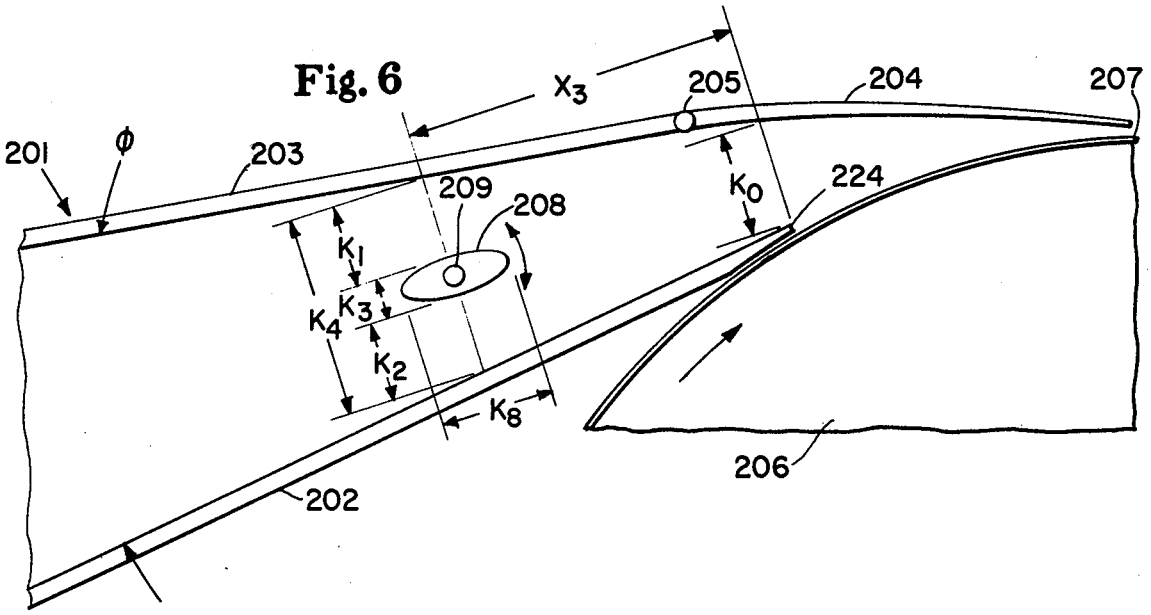
FIG. 6 is a cross-sectional schematic illustration of yet another embodiment of the present invention.
Figure 7:
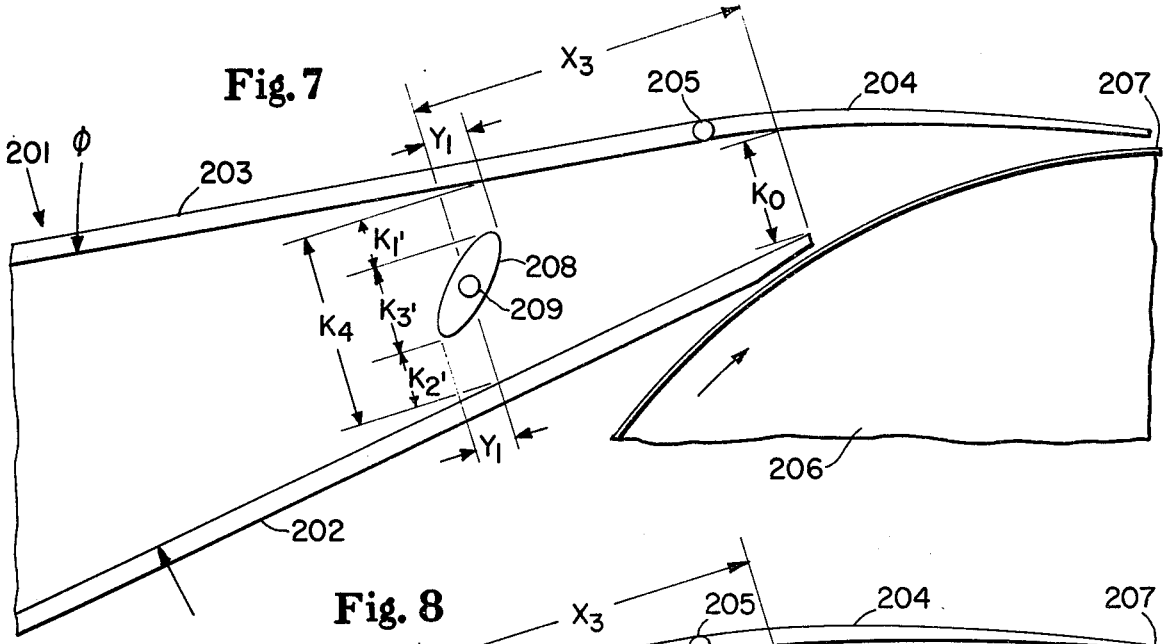
FIG. 7 is a cross-sectional schematic illustration similar to that of FIG. 6, but showing the position of the microturbulence generator after an adjustment has been carried out.
Figure 8:
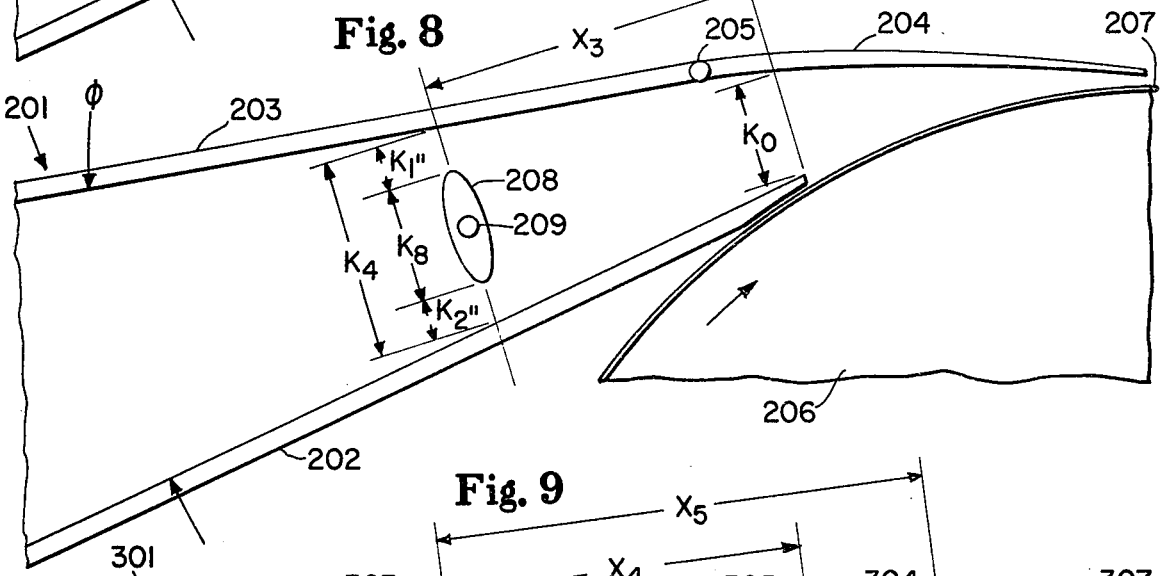
FIG. 8 is a cross-sectional illustration similar to that of FIGS. 6 and 7 showing the microturbulence generator adjusted to the position capable of producing minimum values for $\gamma_b$ and $\gamma_s$.

FIG. 6 depicts yet another embodiment of the present invention wherein a headbox 201 operating in conjunction with Fourdrinier wire 207 about suction breast roll 206 employs an elliptical-shaped microturbulence generator 208 which is uniform in the cross-machine direction and which may be rotated about shaft 209 to optimize the $\gamma_b$ and $\gamma_s$ criteria. The headbox 201 employs a construction generally similar to that illustrated in FIGS. 1 and 3, wherein a roof portion 203, which for purposes of the present specification is considered to be fixed, forms an angle of convergence $\phi$ with the floor portion 202, said roof having a pivotally movable portion 204 adjustable about knuckle 205. The headbox throat having a height $K_0$, as measured in a direction substantially perpendicular to the direction of flow, coincides with the point of termination 224 of the headbox floor portion 202. The headbox throat is also coincident with the point of minimum cross-sectional flow area downstream of the microturbulence generator 208. Shaft 209 to which microturbulence generator 208 is affixed preferably extends through the side walls of the headbox to permit adjustment of the microturublence generator in-use, and is located a distance $X_3$ upstream from the headbox throat. In a preferred embodiment, $X_3$ is between about 1 inch and about 10 inches, most preferably between about 3 inches and about 7 inches. The microturbulence generator 208 which is elliptical in shape has a minor axis $K_3$ and a major axis $K_8$. In the position illustrated in FIG. 6, the major axis $K_8$ of the ellipse is aligned substantially parallel to the direction of the stock flow such that $\gamma_b$ and $\gamma_s$ are defined by the relations $$\gamma_b = \frac{K_1 + K_2}{K_4},$$

where $K_4 = K_1 + K_3 + K_2$, and $$\gamma_s = \frac{K_1 + K_2}{K_0},$$

where $K_1$ and $K_2$ are the heights of the cross-sectional flow areas as measured at a point coincident with the centerline of shaft 209. FIGS. 7 and 8 depict the manner in which shaft 209 may be rotated so as to increase the values of $\gamma_b$ and $\gamma_s$. In the position illustrated in FIG. 7, $$\gamma_b = \frac{K_{1'} + K_{2'}}{K_4} \text{ and } \gamma_s = \frac{K_{1'} + K_{2'}}{K_0}$$

It should, of course, be noted that the cross-sectional flow areas $K_{1'}$ and $K_{2'}$ are no longer measured at a point coincident with the centerline of shaft 209. Rather, $K_1'$ and $K_2'$ are measured in a direction substantially perpendicular to the direction of stock flow at their respective points of minimum cross-sectional flow area in the channel. Thus, for the embodiment illustrated in FIG. 7, $K_1'$ is measured a distance $Y_1$ downstream of the centerline of shaft 209 and $K_2$ is measured a corresponding distance $Y_1$ upstream of the centerline of shaft 209.

FIG. 8 depicts the embodiment of FIG. 6 when the major axis $K_8$ of the microturbulence generator 208 has been aligned in a direction substantially perpendicular to the direction of stock flow in the headbox flow channel. In the latter position, $$\gamma_b = \frac{K_{1''} + K_{2''}}{K_4} \text{ and } \gamma_s = \frac{K_{1''} + K_{2''}}{K_0}.$$

Figure 9:
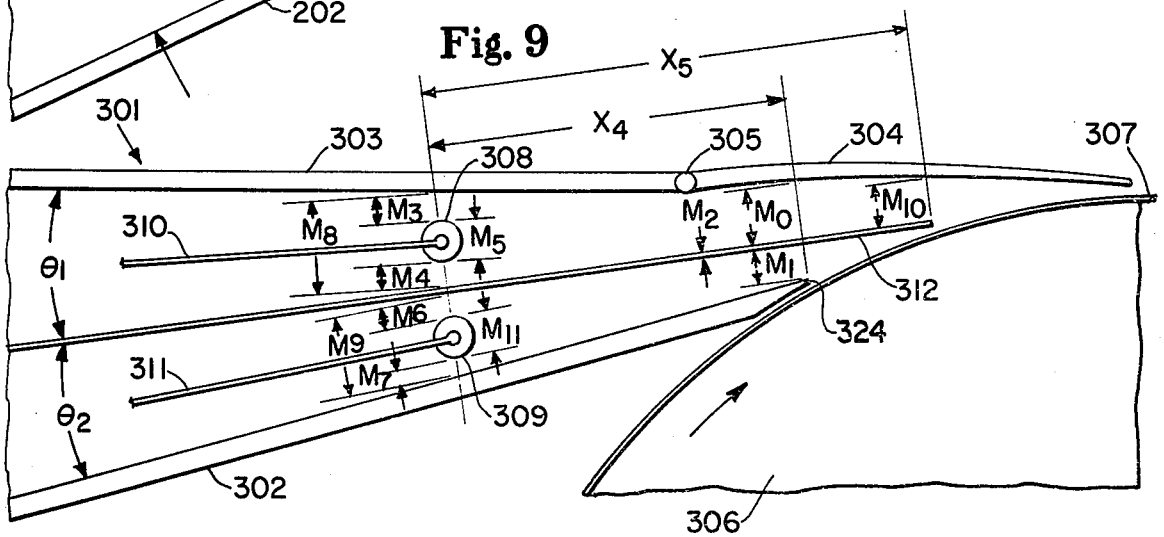
FIG. 9 is a simplified cross-sectional schematic illustration of a headbox employing a flow dividing element capable of separating the uppermost and lowermost slurries into separate flow channels within the headbox, each of said flow channels having a microturbulence generator of the present invention installed therein.

FIG. 9 dipicts yet another embodiment of the present invention wherein the $\gamma_b$ and $\gamma_s$ design parameters described in connection with the present invention are independently applied to each of two flow channels contained within a single headbox 301 having an internal partition leaf 312 suitable for separating similar or dissimilar fibrous stock flows all the way to the point of exit from the headbox. The headbox 301 operates in conjunction with Fourdrinier wire 307 about suction breast roll 306 in a manner similar to the other embodiments disclosed herein. Such headboxes, which may be of either the fixed roof suction breast roll variety or of the twin-wire variety, are particularly useful when forming stratified or layered paper webs of the type generally disclosed in U.S. Pat. No. 3,994,771 issued to Morgan, Jr. et al. on Nov. 30, 1976. In the illustrated embodiment, the headbox 301 is comprised of a ceiling portion 303, which for purposes of the present specification is considered to be fixed, and a floor portion 302. A flexible intermediate dividing member 312 extending across the entire width of the headbox and secured only at its upstream end is provided intermediate said ceiling and floor portions. As with the embodiments of FIGS. 1, 3 and 6, the roof of the headbox has a pivotally movable portion 304 which may be adjusted about knuckle 305. The uppermost flow passage has an angle of convergence $\theta_1$ while the lowermost flow passage has an angle of convergence $\theta_2$. In order to effectively apply the disclosed design criteria, the approximate in-use positioning of the intermediate member 312 at the throat of the headbox must either be determined experimentally or estimated. Since the intermediate member 312 is unattached at its trailing end, it will typically establish an in-use equilibrium position dividing the cross-sectional flow area of the headbox 301 into two segments having heights $M_0$ and $M_1$, as measured at a point corresponding to the point of termination 324 of the headbox floor 302. The actual equilibrium point ultimately assumed is of course determined by the relative pressures and stock flow rates through the uppermost and lowermost flow channels in the headbox. Since the partitioning member 312 extends somewhat beyond the point of termination 324 of the fixed headbox floor portion 302, the uppermost and lowermost flow channels exhibit points of minimum cross-sectional flow area at differing points along the machine direction, i.e., $M_1$ corresponds to the point of minimum area for the lowermost flow channel and $M_{10}$ for the uppermost flow channel.

In a particularly preferred embodiment of the present invention, a cylindrical microturbulence generator 308 of uniform cross-section, extending across the entire width of the papermachine, and supported by a flexible support member 310 secured in an adjustable manner at its upstream end is installed in the uppermost flow channel. A similar microturbulence generator 309 supported by flexible member 311 is likewise supported in the lowermost flow channel. The machine direction positioning of the microturbulence generators 308 and 309 is preferably independently adjustable so that the optimum positioning $X_4$ and $X_5$ of the microturbulence generators from the points of minimum cross-sectional flow area may be carried out independently of one another to optimize microturbulence generation for the particular flow conditions existing in each channel. Thus for the uppermost flow channel, $$\gamma_b = \frac{M_3 + M_4}{M_8},$$

where $M_8 = M_3 + M_5 + M_4$, and $$\gamma_s = \frac{M_3 + M_4}{M_{10}}.$$

For the lowermost flow channel, $$\gamma_b = \frac{M_6 + M_7}{M_9},$$

where $M_9 = M_6 + M_{11} + M_7$, and $$\gamma_s = \frac{M_6 + M_7}{M_1}.$$

Thus, the embodiment of the present invention illustrated in FIG. 9 permits optimization of the level of microturbulence introduced into each of the flow channels of the headbox.

It is of course recognized that the $\gamma_b$ and $\gamma_s$ values described herein may also be adjusted while the papermachine is operational by repositioning either the floor or the ceiling of the headbox flow channel wherein the microturbulence generator is located, or both. Bringing the floor and ceiling closer together will reduce the values of $\gamma_b$ and $\gamma_s$, thereby increasing the intensity of the microturbulence generated, while moving them further apart will increase the values of $\gamma_b$ and $\gamma_s$, thereby reducing the intensity of the microturbulence generated. It should also be noted that while the particular microturbulence generator embodiments illustrated herein are so located as to divide the flow stream into approximately equal segments at the point of restriction and thereby optimize the distribution of microturbulence at the point of momentary expansion, the present invention could also be practiced by supporting an adjustable microturbulence generator such as a plate or similar flow obstructing member oriented generally perpendicular to the direction of flow from the floor or ceiling of the headbox flow channel.

Figure 10:
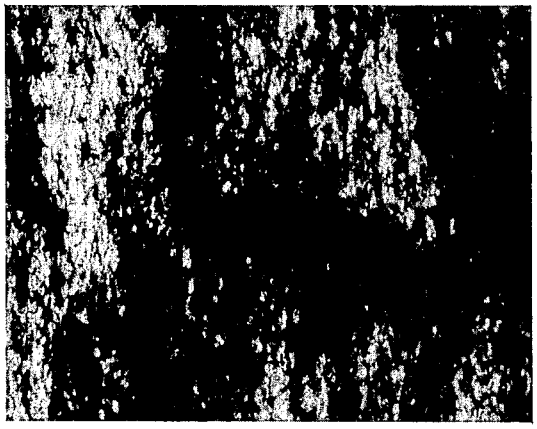
FIG. 10 is a photograph enlarged approximately four times actual size of a paper slurry being discharged from the throat of a prior art headbox employing sufficient macroturbulence, but insufficient microturbulence, in the discharge jet.

As has been pointed out earlier herein, the benefit of optimizing the level of microturbulence introduced into a flowing paper slurry near the throat of the headbox is maximized when the flow has already been subjected to a sufficient degree of macroturbulence generation at the inlet to the headbox. FIG. 10 is a photograph enlarged approximately four times actual size of the situation which typically exists in a prior art style headbox which employs a sufficient degree of macroturbulence, but little or no microturbulence in the discharge jet. The plan view photograph was taken utilizing a high speed, stop action technique on a headbox generally similar to that illustrated in FIG. 3, but without any microturbulence generators. The photograph was taken at a point approximately coincident with the headbox throat. The headbox employed an angle of convergence $\beta$ of approximately 10° and a throat opening $J_0$ of about 0.35 inches. A transparent roof segment 104 and a transparent floor segment 102 were utilized in combination with a high speed stroboscopic light mounted where the suction breast roll 106 would normally be. The photograph was taken while the slurry was moving at a speed of approximately 3,000 feet per minute at a fiber consistency of approximately 0.18 percent. The poor fiber dispersion, the tendency of the fibers to align themselves generally parallel to the machine direction and the cross-machine direction variation in fiber density which produces a streaked effect in the finished sheet are clearly apparent. The predominant machine direction alignment of the fibers in the finished sheets produces high machine direction tensile strengths and low cross-machine direction tensile strengths. This in turn results in undesirably high machine direction to cross-machine direction tensile ratios. Furthermore, the streaks apparent in FIG. 10 result in corresponding cross-machine direction basis weight variations in the finished sheets.

Figure 11:
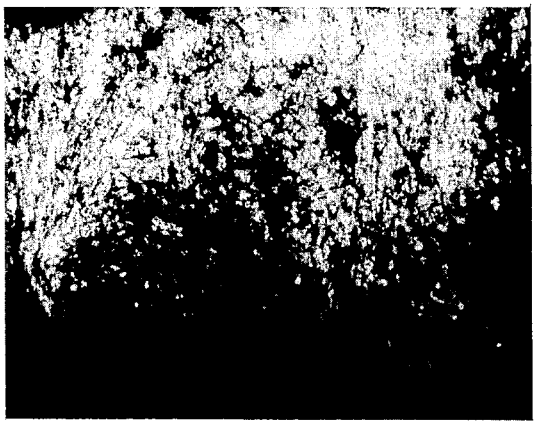
FIG. 11 is a photograph similar to that of FIG. 10 which is typical for a prior art headbox employing excessive macroturbulence and little or no microturbulence in the discharge jet.

FIG. 11, on the other hand, which was prepared in a manner comparable to that of FIG. 10, is typical of a prior art style papermachine headbox employing an excessive level of macroturbulence and little or no microturbulence in the discharge jet. The headbox utilized in the photograph of FIG. 10 was modified by installing a turbulence generator having the uniform cross-section of a right trangle on the floor 102 of the headbox about eight inches upstream of the headbox throat. The triangular-shaped turbulence generator was oriented such that its 90° included angle contacted the headbox floor and its 30° included angle was oriented upstream to produce a 0.90 inch obstruction in the flow channel. This resulted in a $\gamma_b$ value of approximately 0.3 and a $\gamma_s$ value of approximately 0.8, a value which failed to comply with the design criteria of the present invention. The papermachine speed and processing conditions were similar to those of FIG. 10.

While the triangular-shaped turbulence generator did serve to improve fiber dispersion, reduce the predominance of machine direction fiber orientation and reduce the streaking apparent in FIG. 10, surface disturbances and lack of uniform fiber density in the jet are highly visible in FIG. 11. These conditions in the discharge jet result in surface disruptions and lack of basis weight uniformity in the finished sheets, both of which adversely affect sheet quality.

Figure 12:
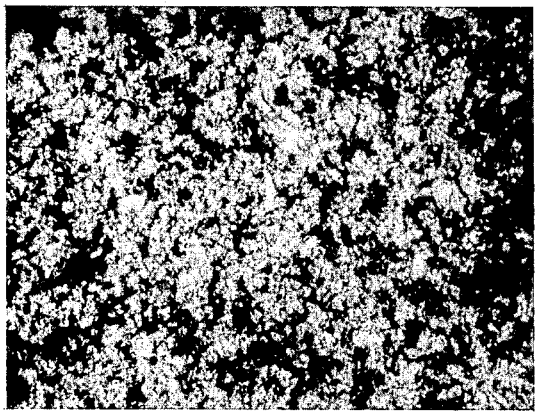
FIG. 12 is a photograph similar to those of FIGS. 10 and 11 wherein sufficient macroturbulence and sufficient microturbulence are employed in a single headbox in conjunction with one another by means of an embodiment of the present invention.

By way of contrast, FIG. 12 represents the condition which exists when microturbulence is imparted to the flow condition illustrated in FIG. 10 by means of an embodiment of the present invention. The triangular-shaped turbulence bump of FIG. 11 was removed, and the headbox utilized in the photograph of FIG. 10 was modified by installing a pair of ¼ inch thick plates 108 and 109 in a manner similar to that generally illustrated in FIG. 3. The trailing ends of the plates were located about 5.9 inches upstream of the headbox throat. This resulted in a $\gamma_b$ value of about 0.4 and a $\gamma_s$ value of about 1.1, values which comply with the design criteria of the present invention. The papermachine speed and processing conditions were similar to those of FIGS. 10 and 11.

As is clear from FIG. 12, the predominance of machine direction fiber orientation, the poor fiber dispersion and the streaks apparent in FIG. 10 are completely eliminated. Furthermore, the surface disturbances and lack of uniform fiber density apparent in FIG. 11 are also eliminated. The resulting paper sheets exhibit a machine direction to cross-machine direction tensile ratio more closely approaching unity due to the high level of fiber dispersion and the more random fiber orientation in the discharge jet. In addition, cross-machine direction basis weight variations are minimal due to the more uniform fiber density. Finally, surface disruptions are minimized due to elimination of excessive macroturbulence in the discharge jet.

Thus, it is apparent that there has been provided, in accordance with the present invention, method and apparatus for generating an optimum level of microturbulence in a macroturbulent flowing stream of paper stock near the throat of a headbox flow channel to improve overall sheet formation characteristics, improve fiber dispersion, randomize fiber orientation and reduce the overall tensile ratio of finished paper sheets so produced. It should be noted, however, that while the invention has been described in conjunction with single wire fixed roof style headboxes typically employed with a suction breast roll style papermachine, the present invention may be employed with equal facility in headboxes suitable for use with twin-wire style papermachines. Furthermore, depending on the particular formation characteristics desired by the papermaker, a multiplicity of microturublence generators of the present invention may be employed in series with one another in a single flow channel. It is thus evident that many alternatives, modifications and variations of the present invention will be apparent to those skilled in the art in light of the foregoing description. Accordingly, it is intended to embrace all such alternatives, modifications, and variations that fall within the spirit and broad scope of the appended claims.

What is claimed is:

1. In a papermaking machine headbox flow channel for delivering an aqueous papermaking stock to a foraminous surface at a throat velocity of at least about 800 feet per minute, said flow channel having an angle of convergence between about 4° and about 20°, the improvement comprising a microturbulence generator located in said flow channel between about 1 inch and about 10 inches upstream of the point of minimum cross-sectional flow area of said flow channel, said microturbulence generator exhibiting a $\gamma_b$ value between about 0.3 and about 0.7, where $$\gamma_b = \frac{\left[\begin{array}{l}\text{minimum cross-sectional flow area of headbox}\\ \text{flow channel due to presence of micro-}\\ \text{turbulence generator as measured at said}\\ \text{microturbulence generator}\end{array}\right]}{\left[\begin{array}{l}\text{maximum cross-sectional flow area of head-}\\ \text{box flow channel which would exist absent}\\ \text{microturbulence generator as measured at}\\ \text{said microturbulence generator}\end{array}\right]},$$

and a $\gamma_s$ value between about 1.0 and about 1.6, where $$\gamma_s = \frac{\left[\begin{array}{l}\text{minimum cross-sectional flow area of headbox flow}\\ \text{channel due to presence of microturbulence generator}\\ \text{as measured at said microturbulence generator}\end{array}\right]}{\left[\begin{array}{l}\text{minimum cross-sectional flow area of said flow}\\ \text{channel downstream of said microturbulence generator}\end{array}\right]},$$

whereby said flow channel produces a paper sheet exhibiting improved formation characteristics, improved fiber dispersion, randomized fiber orientation and reduced machine direction to cross-machine direction tensile ratio characteristics.

2. The improved apparatus of claim 1, including means for adjusting said microturbulence generator in-use to either increase or decrease the values of $\gamma_b$ and $\gamma_s$.

3. The improved apparatus of claim 2, wherein said means for adjusting said microturbulence generator in-use comprises means for advancing or retracting said microturbulence generator in the machine direction.

4. The improved apparatus of claim 2, wherein said means for adjusting said microturbulence generator in-use comprises means for rotating said microturbulence generator about a line substantially perpendicular to the direction of stock flow.

5. The improved apparatus of claim 3, wherein said microturbulence generator comprises at least one cylinder of uniform cross-section secured to the trailing edge of a flexible support member adjustably secured to the headbox only at its upstream end, the downstream end of said support member being free to seek an equilibrium position within the flow channel in response to stock flow.

6. The improved apparatus of claim 3, wherein said microturbulence generator is comprised of at least one plate of uniform cross-section in both the machine and cross-machine directions.

7. The improved apparatus of claim 4, wherein said microturbulence generator exhibits a uniform elliptical cross-section.

8. The improved apparatus of claim 7, wherein said elliptical microturbulence generator is adjusted by rotation about its axis.

9. The improved apparatus of claim 2, wherein said microturbulence generator comprises a flow obstructing member oriented substantially perpendicular to the direction of flow in said flow channel and supported from one of the walls defining said flow channel, said apparatus including means external to said flow channel for extending and retracting said flow obstructing member into or out of said flow channel while said papermachine headbox is in use.

10. In a papermaking machine headbox flow channel for delivering an aqueous papermaking stock to a formainous forming surface at a throat velocity of at least about 800 feet per minute, said flow channel having an angle of convergence between about 6° and about 15°, the improvement comprising a microturbulence generator located in said flow channel between about 3 inches and about 7 inches upstream of the throat of said flow channel, said microturbulence generator exhibiting a $\gamma_b$ value between about 0.3 and about 0.7,
where $$\gamma_b = \frac{\left[\begin{array}{l}\text{minimum cross-sectional flow area of headbox}\\ \text{flow channel due to presence of micro-}\\ \text{turbulence generator as measured at said}\\ \text{microturbulence generator}\end{array}\right]}{\left[\begin{array}{l}\text{maximum cross-sectional flow area of head-}\\ \text{box flow channel which would exist absent}\\ \text{microturbulence generator as measured at}\\ \text{said microturbulence generator}\end{array}\right]},$$

and a $\gamma_s$ value between about 1.0 and about 1.6, where $$\gamma_s = \frac{\left[\begin{array}{l}\text{minimum cross-sectional flow area of headbox}\\ \text{flow channel due to presence of micro-}\\ \text{turbulence generator as measured at micro-}\\ \text{turbulence generator}\end{array}\right]}{\left[\begin{array}{l}\text{minimum cross-sectional flow area of said}\\ \text{flow channel downstream of said micro-}\\ \text{turbulence generator}\end{array}\right]},$$

whereby said flow channel produces a paper sheet exhibiting improved formation characteristics, improved fiber dispersion, randomized fiber orientation and reduced machine direction to cross-machine direction tensile ratio characteristics.

11. The improved apparatus of claim 10, including means for adjusting the microturbulence generator in-use to either increase or decrease the values of $\gamma_b$ and $\gamma_s$.

12. A method for forming a moist paper web exhibiting improved formation characteristics, improved fiber dispersion and randomized fiber orientation without undesirable surface disruptions at papermachine speeds of about 800 feet per minute or greater, said method comprising:

(a) introducing macroturbulent flow to a dilute aqueous slurry of papermaking fibers upon introduction to a convergent papermachine headbox flow channel;

(b) directing said macroturblent flow of papermaking fibers toward the throat of said flow channel at an angle of convergence between about 4° and about 20°;

(c) introducing microturblence to said macroturbulent flow of papermaking fibers within said headbox flow channel by first constricting and then momentarily expanding the flow of said papermaking fibers at a point between about 1 and about 10 inches upstream of the throat of said headbox flow channel, said point being sufficiently near the throat of said headbox flow channel that the microturbulence remaining in the discharge jet minimizes flocculation and promotes dispersion and random orientation of said papermaking fibers; and (d) discharging said flow of papermaking fibers through said headbox throat in the form of a jet to form a moist paper web on a traveling foraminous support member.

13. The method of claim 12 wherein said flow of papermaking fibers is momentarily expanded to a cross-sectional area between about 1.4 and about 3.3 times its constricted cross-sectional area.

14. The method of claim 13 including the step of reconstricting said flow of papermaking fibers after said momentary expansion has been carried out to a cross-sectional area between about 0.625 and about 1.0 times its original constricted cross-sectional area at the throat of said headbox flow channel.

* * * * *

UNITED STATES PATENT AND TRADEMARK OFFICE

CERTIFICATE OF CORRECTION

PATENT NO. : 4,133,713

DATED : January 9, 1979

INVENTOR(S) : Strong C. Chuang

It is certified that error appears in the above-identified patent and that said Letters Patent are hereby corrected as shown below:

Column 1, line 29, "of" should read -- by --.

Column 3, line 28, "theses" should read -- these --.

Column 5, line 11, "it" should read --its --.

Column 8, line 8-9, "convengence" should read -- convergence --.

Column 8, line 19, "wil" should read -- will --.

Column 8, line 64, "flate" should read -- flat --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*